US005742734A

United States Patent [19]

DeJaco et al.

[11] Patent Number: 5,742,734

[45] Date of Patent: Apr. 21, 1998

[54] ENCODING RATE SELECTION IN A VARIABLE RATE VOCODER

[75] Inventors: Andrew P. DeJaco; William R. Gardner, both of San Diego, Calif.

[73] Assignee: Qualcomm Incorporated, San Diego, Calif.

[21] Appl. No.: 288,413

[22] Filed: Aug. 10, 1994

[51] Int. Cl.[6] ..... G10L 9/14

[52] U.S. Cl. ..... 395/2.35; 395/2.28; 395/2.38; 395/2.91

[58] Field of Search ..... 395/2.38, 2.39, 395/2.42, 2.28, 2.35, 2.91; 375/243, 254; 381/29

[56] References Cited

U.S. PATENT DOCUMENTS

| | | | |
|---|---|---|---|
| Re. 32,580 | 1/1988 | Bishnu et al. | 395/2.28 |
| 3,633,107 | 1/1972 | Brady | 375/267 |
| 4,012,595 | 3/1977 | Ota | 370/435 |

(List continued on next page.)

FOREIGN PATENT DOCUMENTS

| | | | |
|---|---|---|---|
| 0167364 | 1/1986 | European Pat. Off. | G10L 3/00 |
| 0190796 | 8/1986 | European Pat. Off. | H03H 17/02 |

OTHER PUBLICATIONS

John D. Hoyt and Harry Wechsler, "Detection of Human Speech in Structured Noise", Proceedings of ICASSP '94, vol. II, pp. 237–240, Apr. 1994.

John D. Hoyt and Harry Wechlser, "RBF Models for Detection of Human Speech in Structured Noise", Proceedings of the 1994 IEEE International Conference on Neural Networks, pp. 4493–4496, Jul. 1994.

*Variable Rate Speech Coding for Asynchronous Transfer Mode,* Hiroshi Nakada and Ken-Ichi Sato, IEEE Transactions on Communications. vol. 38. No. 3., Mar. 1990, pp. 277–284.

*Stochastic Coding of Speech Signals at Very Low Bit Rates: The Importance of Speech Perception,* Manfred R. Schroeder and Bishnu S. Atal, IEEE Speech Communication 4, pp. 155–162.

*Predictive Coding of Speech at Low Bit Rates,* Bishnu S. Atal, IEEE Transactions on Communications, vol. COM-30, No. 4, Apr. 1982, pp. 600–614.

*Improving Performance of Multi-Pulse LPC Coders at Low Bit Rates,* Sharad Singhai and Bishnu S. Atal, Acoustics Research Department AT&T Bell Laboratories, Murray Hill, NJ 07974, pp. 1.3.1–1.3.4.

*Adaptive Predicitive Coding of Speech Signals,* B.S. Atal and M.R. Schroeder, Bell Syst. Tech. J., vol. 49, Oct. 1970, pp. 1973–1986.

*Stochastic Coding of Speech Signals at Very Low Bit Rates,* Bishnu S. Atal and Manfred R. Schroeder, IEEE, Sep. 1984.

*Variable Bit Rate Adaptive Predictive Coder,* Ioannis S. Debes et al., IEEE, 1992, pp. 511–517.

(List continued on next page.)

*Primary Examiner*—Allen R. MacDonald
*Assistant Examiner*—Tālivaldis Ivars Šmits
*Attorney, Agent, or Firm*—Russell B. Miller; Sean English; Linli L. Golden

[57] ABSTRACT

It is a first objective of the present invention to provide a method by which to reduce the probability of coding low energy unvoiced speech as background noise. The present invention determines an encoding rate by examining subbands of the input signal, by this method unvoiced speech can be distinguished from background noise. A second objective of the present invention is to provide a means by which to set the threshold levels that takes into account signal energy as well as background noise energy. In the present invention, the background noise is not used to determine threshold values, rather the signal to noise ratio of an input signal is use to determine the threshold values. A third objective of the present invention is to provide a method for coding music passing through a variable rate vocoder. The present invention examines the periodicity of the input signal to distinguish music from background noise.

22 Claims, 1 Drawing Sheet

U.S. PATENT DOCUMENTS

| | | | |
|---|---|---|---|
| 4,076,958 | 2/1978 | Fulghum | 395/2.77 |
| 4,214,125 | 7/1980 | Mozer et al. | 395/2.77 |
| 4,360,708 | 11/1982 | Taguchi et al. | 395/2.38 |
| 4,535,472 | 8/1985 | Tomcik | 395/2.38 |
| 4,610,022 | 9/1986 | Kitayama et al. | 395/2.14 |
| 4,672,669 | 6/1987 | Desblanche et al. | 395/2.46 |
| 4,672,670 | 6/1987 | Wang et al. | 395/2.26 |
| 4,677,671 | 6/1987 | Galand et al. | 395/2.21 |
| 4,771,465 | 9/1988 | Bronson et al. | 395/2.16 |
| 4,797,925 | 1/1989 | Lin | 395/2.32 |
| 4,797,929 | 1/1989 | Gerson et al. | 395/2.52 |
| 4,817,157 | 3/1989 | Gerson | 395/2.39 |
| 4,827,517 | 5/1989 | Atal et al. | 395/2.27 |
| 4,843,612 | 6/1989 | Brusch et al. | 375/200 |
| 4,850,022 | 7/1989 | Honda et al. | 395/2.16 |
| 4,852,179 | 7/1989 | Fette | 395/2.39 |
| 4,856,068 | 8/1989 | Quatieri, Jr. et al. | 395/2.36 |
| 4,864,561 | 9/1989 | Ashenfelter et al. | 370/435 |
| 4,868,867 | 9/1989 | Davidson et al. | 395/2.39 |
| 4,885,790 | 12/1989 | McAulay et al. | 395/2.74 |
| 4,890,327 | 12/1989 | Bertrand et al. | 395/2.28 |
| 4,899,384 | 2/1990 | Crouse et al. | 395/2.38 |
| 4,899,385 | 2/1990 | Ketchum et al. | 395/2.32 |
| 4,903,301 | 2/1990 | Kondo et al. | 395/2.92 |
| 4,905,288 | 2/1990 | Gerson et al. | 395/2.54 |
| 4,933,957 | 6/1990 | Bottau et al. | 375/244 |
| 4,965,789 | 10/1990 | Bottau et al. | 370/465 |
| 4,991,214 | 2/1991 | Freeman et al. | 395/2.32 |
| 5,023,910 | 6/1991 | Thomson | 395/2.15 |
| 5,054,072 | 10/1991 | McAulay et al. | 395/2.16 |
| 5,054,075 | 10/1991 | Hong et al. | 381/36 |
| 5,060,269 | 10/1991 | Zinser | 395/2.16 |
| 5,077,798 | 12/1991 | Ichikawa et al. | 395/2.31 |
| 5,093,863 | 3/1992 | Galand et al. | 395/2.16 |
| 5,103,459 | 4/1992 | Gilhousen et al. | 370/200 |
| 5,113,448 | 5/1992 | Nomura et al. | 395/2.28 |
| 5,140,638 | 8/1992 | Moulsley et al. | 395/2.28 |
| 5,157,760 | 10/1992 | Akagiri | 395/2.42 |
| 5,185,800 | 2/1993 | Mahieux | 395/2.91 |
| 5,187,745 | 2/1993 | Yip et al. | 395/2.28 |
| 5,206,884 | 4/1993 | Bhaskar | 375/254 |
| 5,222,189 | 6/1993 | Fielder | 395/2.38 |
| 5,298,674 | 3/1994 | Yun | 84/616 |
| 5,301,255 | 4/1994 | Nagai et al. | 395/2.39 |
| 5,317,672 | 5/1994 | Crossman et al. | 395/2.38 |
| 5,353,375 | 10/1994 | Goto et al. | 395/2.38 |
| 5,457,769 | 10/1995 | Valley | 395/2.19 |
| 5,469,474 | 11/1995 | Kitabatake | 375/243 |

OTHER PUBLICATIONS

*Variable Rate Speech Coding with Online Segmentation and Fast Algebraic Codes,* R. Di Francesco, et al., IEEE, 1990, pp. 233–236.

*Variable Rate Speech Coding: A Review,* Acoustics Research Department AT&T Bell Laboratories Murray Hill, NJ 07974, IEEE, Sep. 1984. N.S. Jayant.

*Fast Methods for the CELP Speech Coding Algorithm,* W. Bastiaan Kleijn, et al, Transactions on Acoustics Speech, and Signal Processing, vol. 38, No. 8, Aug. 1990, pp. 1330–1341.

*DSP Chips Can Produce Random Numbers Using Proven Algorithm,* Paul Mennen, Tektronix Inc., EDN Jan. 21, 1991, pp. 141–146.

*Code–Excited Linear Prediction (CELP): High–Quality Speech at Very Low Bit Rates,* Bishnu S., Atal and Manfred R. Schroeder, IEEE, 1985, pp. 937–940.

*A 4.8 KBPS Code Excited Linear Predictive Coder,* Thomas E. Tremain et al., U.S. Department of Defense, R5 Fort Meade, Maryland, U.S.A. 20755–6000, pp. 491–496.

*Phonetically–Based Vector Excitation Coding of Speech at 3.6 kbps.* Speech Processing 1 S1, 1989 International Conference on Acoustics, Speech, and Signal Processing, IEEE, vol. 1., Feb. 1989, pp. 49–52. Wang and Gersho.

ENCODING RATE SELECTION IN A VARIABLE RATE VOCODER

BACKGROUND OF THE INVENTION

I. Field of the Invention

The present invention relates to vocoders. More particularly, the present invention relates to a novel and improved method for determining speech encoding rate in a variable rate vocoder.

II. Description of the Related Art

Variable rate speech compression systems typically use some form of rate determination algorithm before encoding begins. The rate determination algorithm assigns a higher bit rate encoding scheme to segments of the audio signal in which speech is present and a lower rate encoding scheme for silent segments. In this way a lower average bit rate will be achieved while the voice quality of the reconstructed speech will remain high. Thus to operate efficiently a variable rate speech coder requires a robust rate determination algorithm that can distinguish speech from silence in a variety of background noise environments.

One such variable rate speech compression system or variable rate vocoder is disclosed in copending U.S. Pat. No. 5,414,796 filed Jun. 11, 1991, entitled "Variable Rate Vocoder" and assigned to the assignee of the present invention, the disclosure of which is incorporated by reference. In this particular implementation of a variable rate vocoder, input speech is encoded using Code Excited Linear Predictive Coding (CELP) techniques at one of several rates as determined by the level of speech activity. The level of speech activity is determined from the energy in the input audio samples which may contain background noise in addition to voiced speech. In order for the vocoder to provide high quality voice encoding over varying levels of background noise, an adaptively adjusting threshold technique is required to compensate for the effect of background noise on the rate decision algorithm.

Vocoders are typically used in communication devices such as cellular telephones or personal communication devices to provide digital signal compression of an analog audio signal that is converted to digital form for transmission. In a mobile environment in which a cellular telephone or personal communication device may be used, high levels of background noise energy make it difficult for the rate determination algorithm to distinguish low energy unvoiced sounds from background noise silence using a signal energy based rate determination algorithm. Thus unvoiced sounds frequently get encoded at lower bit rates and the voice quality becomes degraded as consonants such as "s", "x", "ch", "sh", "t", etc. are lost in the reconstructed speech.

Vocoders that base rate decisions solely on the energy of background noise fail to take into account the signal strength relative to the background noise in setting threshold values. A vocoder that bases its threshold levels solely on background noise tends to compress the threshold levels together when the background noise rises. If the signal level were to remain fixed this is the correct approach to setting the threshold levels, however, were the signal level to rise with the background noise level, then compressing the threshold levels is not an optimal solution. An alternative method for setting threshold levels that takes into account signal strength is needed in variable rate vocoders.

A final problem that remains arises during the playing of music through background noise energy based rate decision vocoders. When people speak, they must pause to breathe which allows the threshold levels to reset to the proper background noise level. However, in transmission of music through a vocoder, such as arises in music-on-hold conditions, no pauses occur and the threshold levels will continue rising until the music starts to be coded at a rate less than full rate. In such a condition the variable rate coder has confused music with background noise.

SUMMARY OF THE INVENTION

The present invention is a novel and improved method and apparatus for determining an encoding rate in a variable rate vocoder. It is a first objective of the present invention to provide a method by which to reduce the probability of coding low energy unvoiced speech as background noise. In the present invention, the input signal is filtered into a high frequency component and a low frequency component. The filtered components of the input signal are then individually analyzed to detect the presence of speech. Because unvoiced speech has a high frequency component its strength relative to a high frequency band is more distinct from the background noise in that band than it is compared to the background noise over the entire frequency band.

A second objective of the present invention is to provide a means by which to set the threshold levels that takes into account signal energy as well as background noise energy. In the present invention, the setting of voice detection thresholds is based upon an estimate of the signal to noise ratio (SNR) of the input signal. In the exemplary embodiment, the signal energy is estimated as the maximum signal energy during times of active speech and the background noise energy is estimated as the minimum signal energy during times of silence.

A third objective of the present invention is to provide a method for coding music passing through a variable rate vocoder. In the exemplary embodiment, the rate selection apparatus detects a number of consecutive frames over which the threshold levels have risen and checks for periodicity over that number of frames. If the input signal is periodic this would indicate the presence of music. If the presence of music is detected then the thresholds are set at levels such that the signal is coded at full rate.

BRIEF DESCRIPTION OF THE DRAWINGS

The features, objects, and advantages of the present invention will become more apparent from the detailed description set forth below when taken in conjunction with the drawing in which like reference characters identify correspondingly throughout and wherein.

DETAILED DESCRIPTION OF THE PREFERRED EMBODIMENTS

Figure 1:
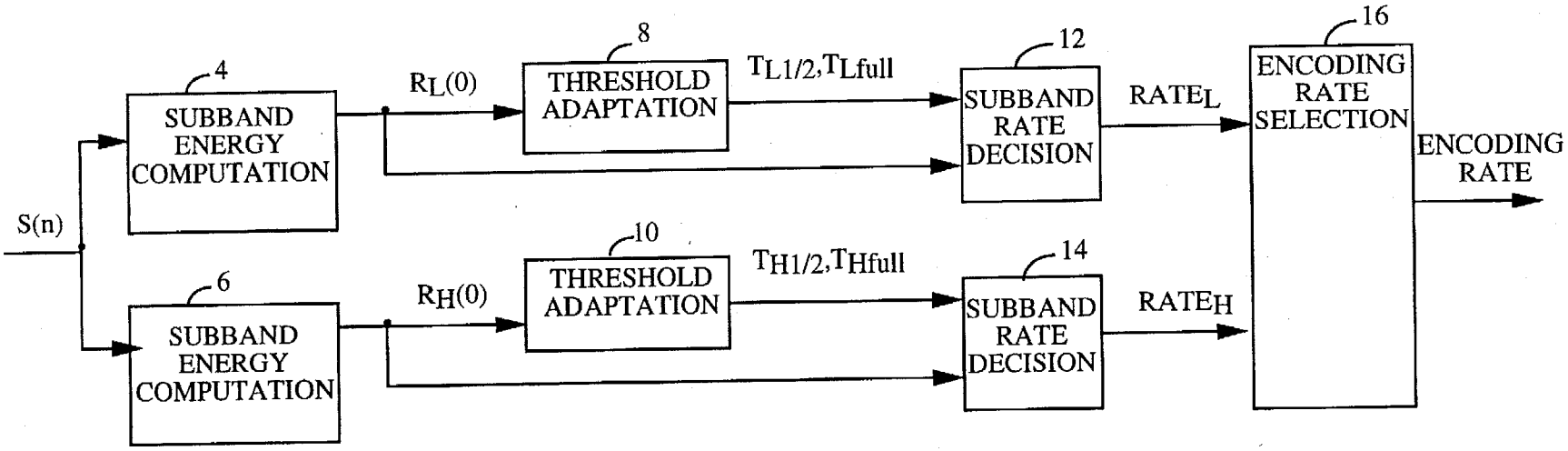
FIG. 1 is a block diagram of the present invention.

Referring to FIG. 1 the input signal, S(n), is provided to subband energy computation element 4 and subband energy computation element 6. The input signal S(n) is comprised of an audio signal and background noise. The audio signal is typically speech, but it may also be music. In the exemplary embodiment, S(n) is provided in twenty millisecond frames of 160 samples each. In the exemplary embodiment, input signal S(n) has frequency components from 0 kHz to 4 kHz, which is approximately the bandwidth of a human speech signal.

In the exemplary embodiment, the 4 kHz input signal, S(n), is filtered into two separate subbands. The two separate subbands lie between 0 and 2 kHz and 2 kHz and 4 kHz respectively. In an exemplary embodiment, the input signal may be divided into subbands by subband filters, the design of which are well known in the art and detailed in U.S. patent application Ser. No. 08/189,819 filed Feb. 1, 1994, entitled "Frequency Selective Adaptive Filtering", and assigned to the assignee of the present invention, incorporated by reference herein.

The impulse responses of the subband filters are denoted $h_L(n)$, for the lowpass filter, and $h_H(n)$, for the highpass filter. The energy of the resulting subband components of the signal can be computed to give the values $R_L(0)$ and $R_H(0)$, simply by summing the squares of the subband filter output samples, as is well known in the art.

In a preferred embodiment, when input signal S(n) is provided to subband energy computation element 4, the energy value of the low frequency component of the input frame, $R_L(0)$, is computed as:

$$R_L(0) = R_S(0) \cdot R_{h_L}(0) + 2 \cdot \sum_{i=1}^{L-1} R_S(i) \cdot R_{h_L}(i), \tag{1}$$

where L is the number taps in the lowpass filter with impulse response $h_L(n)$, where $R_S(i)$ is the autocorrelation function of the input signal, S(n), given by the equation:

$$R_S(i) = \sum_{n=1}^{N} S(n) \cdot S(N-i), \text{ for } i \in [0, L-1] \tag{2}$$

where N is the number of samples in the frame, and where $R_{hL}$ is the autocorrelation function of the lowpass filter $h_L(n)$ given by:

$$\begin{aligned} R_{h_L}(i) &= \sum_{n=0}^{L-1} h_L(n) \cdot h_L(n-i). && \text{for } i \in [0, L-1] \\ &= 0 && \text{else} \end{aligned} \tag{3}$$

The high frequency energy, $R_H(0)$, is computed in a similar fashion in subband energy computation element 6.

The values of the autocorrelation function of the subband filters can be computed ahead of time to reduce the computational load. In addition, some of the computed values of $R_S(i)$ are used in other computations in the coding of the input signal, S(n), which further reduces the net computational burden of the encoding rate selection method of the present invention. For example, the derivation of LPC filter tap values requires the computation of a set of input signal autocorrelation coefficients.

The computation of LPC filter tap values is well known in the art and is detailed in the abovementioned U.S. Pat. No. 5,414,796. If one were to code the speech with a method requiring a ten tap LPC filter only the values of $R_S(i)$ for i values from 11 to L−1 need to be computed, in addition to those that are used in the coding of the signal, because $R_S(i)$ for i values from 0 to 10 are used in computing the LPC filter tap values. In the exemplary embodiment, the subband filters have 17 taps, L=17.

Subband energy computation element 4 provides the computed value of $R_L(0)$ to subband rate decision element 12, and subband energy computation element 6 provides the computed value of $R_H(0)$ to subband rate decision element 14. Rate decision element 12 compares the value of $R_L(0)$ against two predetermined threshold values $T_{L1/2}$ and $T_{Lfull}$ and assigns a suggested encoding rate, $RATE_L$, in accordance with the comparison. The rate assignment is conducted as follows:

$$RATE_L = \text{eighth rate } R_L(0) \leqq T_{L1/2} \tag{4}$$

$$RATE_L = \text{half rate } T_{L1/2} < R_L(0) \leqq T_{Lfull} \tag{5}$$

$$RATE_L = \text{full rate } R_L(0) > T_{Lfull} \tag{6}$$

Subband rate decision element 14 operates in a similar fashion and selects a suggest encoding rate, $RATE_H$, in accordance with the high frequency energy value $R_H(0)$ and based upon a different set of threshold values $T_{H1/2}$ and $T_{Hfull}$. Subband rate decision element 12 provides its suggested encoding rate, $RATE_L$, to encoding rate selection element 16, and subband rate decision element 14 provides its suggested encoding rate, $RATE_H$, to encoding rate selection element 16. In the exemplary embodiment, encoding rate selection element 16 selects the higher of the two suggest rates and provides the higher rate as the selected ENCODING RATE.

Subband energy computation element 4 also provides the low frequency energy value, $R_L(0)$, to threshold adaptation element 8, where the threshold values $T_{L1/2}$ and $T_{Lfull}$ for the next input frame are computed. Similarly, subband energy computation element 6 provides the high frequency energy value, $R_H(0)$, to threshold adaptation element 10, where the threshold values $T_{H1/2}$ and $T_{Hfull}$ for the next input frame are computed.

Threshold adaptation element 8 receives the low frequency energy value, $R_L(0)$, and determines whether S(n) contains background noise or audio signal. In an exemplary implementation, the method by which threshold adaptation element 8 determines if an audio signal is present is by examining the normalized autocorrelation function for the $i^{th}$ frame $NACF^{(i)}$, which is given by the equation:

$$NACF(i) = \max_m \frac{\sum_{n=0}^{N-1} e(n) \cdot e(n-m)}{\frac{1}{2} \cdot \left[ \sum_{n=0}^{n-1} e^2(n) + \sum_{n=0}^{N-1} e^2(n-m) \right]}, \tag{7}$$

where m>0, and e(n) is the formant residual signal that results from filtering the input signal, S(n), by an LPC filter.

The design of and filtering of a signal by an LPC filter is well known in the art and is detailed in aforementioned U.S. Pat. No. 5,414,796. The input signal, S(n), is filtered by the LPC filter to remove interaction of the formants. NACF is compared against a threshold value to determine if an audio signal is present. If NACF is greater than a predetermined threshold value, it indicates that the input frame has a periodic characteristic indicative of the presence of an audio signal such as speech or music. Note that while parts of speech and music are not periodic and will exhibit low values of NACF, background noise typically never displays any periodicity and nearly always exhibits low values of NACF.

If it is determined that S(n) contains background noise, the value of NACF is less than a threshold value TH1, then the value $R_L(0)$ is used to update the value of the current background noise estimate $BGN_L$. In the exemplary embodiment, TH1 is 0.35. $R_L(0)$ is compared against the current value of background noise estimate $BGN_L$. If $R_L(0)$ is less than $BGN_L$, then the background noise estimate $BGN_L$ is set equal to $R_L(0)$ regardless of the value of NACF.

The background noise estimate $BGN_L$ is only increased when NACF is less than threshold value TH1. If $R_L(0)$ is greater than $BGN_L$ and NACF is less than TH1, then the background noise energy $BGN_L$ is set $\alpha_1 \cdot BGN_L$, where $\alpha_1$ is a number greater than 1. In the exemplary embodiment, $\alpha_1$ is equal to 1.03. $BGN_L$ will continue to increase as long as NACF is less than threshold value TH1 and $R_L(0)$ is greater than the current value of $BGN_L$, until $BGN_L$ reaches a predetermined maximum value $BGN_{max}$ at which point the background noise estimate $BGN_L$ is set to $BGN_{max}$.

If an audio signal is detected, signified by the value of NACF exceeding a second threshold value TH2, then the signal energy estimate, $S_L$, is updated. In the exemplary embodiment, TH2 is set to 0.5. The value of $R_L(0)$ is compared against a current lowpass signal energy estimate, $S_L$. If $R_L(0)$ is greater than the current value of $S_L$, then $S_L$ is set equal to $R_L(0)$. If $R_L(0)$ is less than the current value of $S_L$, then $S_L$ is set equal to $\alpha_2 \cdot S_L$, again only if NACF is greater than TH2. In the exemplary embodiment, $\alpha_2$ is set to 0.96.

Threshold adaptation element 8 then computes a signal to noise ratio estimate in accordance with equation 8 below:

$$SNR_L = 10 \cdot \log\left[\frac{S_L}{BGN_L}\right] \tag{8}$$

Threshold adaptation element 8 then determines an index of the quantized signal to noise ratio $I_{SNRL}$ in accordance with equation 9–12 below:

$$I_{SNRL} = nint\left[\frac{SNR_L - 20}{5}\right], \text{ for } 20 < SNR_L < 55, \tag{9}$$

where nint is a function that rounds the fractional value to the nearest integer.

Threshold adaptation element 8, then selects or computes two scaling factors, $k_{L1/2}$ and $k_{Lfull}$, in accordance with the signal to noise ratio index, $I_{SNRL}$. An exemplary scaling value lookup table is provided in table 1 below:

TABLE 1

| $I_{SNRL}$ | $K_{L1/2}$ | $K_{Lfull}$ |
|---|---|---|
| 0 | 7.0 | 9.0 |
| 1 | 7.0 | 12.6 |
| 2 | 8.0 | 17.0 |
| 3 | 8.6 | 18.5 |
| 4 | 8.9 | 19.4 |
| 5 | 9.4 | 20.9 |
| 6 | 11.0 | 25.5 |
| 7 | 15.8 | 39.8 |

These two values are used to compute the threshold values for rate selection in accordance with the equations below:

$$T_{L1/2} = K_{L1/2} \cdot BGN_L, \text{ and} \tag{11}$$

$$T_{Lfull} = K_{Lfull} \cdot BGN_L, \tag{12}$$

where $T_{L1/2}$ is low frequency half rate threshold value and $T_{Lfull}$ is the low frequency full rate threshold value.

Threshold adaptation element 8 provides the adapted threshold values $T_{L1/2}$ and $T_{Lfull}$ to rate decision element 12. Threshold adaptation element 10 operates in a similar fashion and provides the threshold values $T_{H1/2}$ and $T_{Hfull}$ to subband rate decision element 14.

The initial value of the audio signal energy estimate S, where S can be $S_L$ or $S_H$, is set as follows. The initial signal energy estimate, $S_{INIT}$, is set to −18.0 dBm0, where 3.17 dBm0 denotes the signal strength of a full sine wave, which in the exemplary embodiment is a digital sine wave with an amplitude range from −8031 to 8031. $S_{INIT}$ is used until it is determined that an acoustic signal is present.

The method by which an acoustic signal is initially detected is to compare the NACF value against a threshold, when the NACF exceeds the threshold for a predetermined number consecutive frames, then an acoustic signal is determined to be present. In the exemplary embodiment, NACF must exceed the threshold for ten consecutive frames. After this condition is met the signal energy estimate, S, is set to the maximum signal energy in the preceding ten frames.

The initial value of the background noise estimate $BGN_L$ is initially set to $BGN_{max}$. As soon as a subband frame energy is received that is less than $BGN_{max}$, the background noise estimate is reset to the value of the received subband energy level, and generation of the background noise $BGN_L$ estimate proceeds as described earlier.

In a preferred embodiment a hangover condition is actuated when following a series of full rate speech frames, a frame of a lower rate is detected. In the exemplary embodiment, when four consecutive speech frames are encoded at full rate followed by a frame where ENCODING RATE is set to a rate less than full rate and the computed signal to noise ratios are less than a predetermined minimum SNR, the ENCODING RATE for that frame is set to full rate. In the exemplary embodiment the predetermined minimum SNR is 27.5 dBas defined in equation 8.

In the preferred embodiment, the number of hangover frames is a function of the signal to noise ratio. In the exemplary embodiment, the number of hangover frames is determined as follows:

$$\#\text{hangover frames}=1 \quad 22.5<SNR<27.5, \tag{13}$$

$$\#\text{hangover frames}=2 \quad SNR \leqq 22.5, \tag{14}$$

$$\#\text{hangover frames}=0 \quad SNR \geqq 27.5. \tag{15}$$

The present invention also provides a method with which to detect the presence of music, which as described before lacks the pauses which allow the background noise measures to reset. The method for detecting the presence of music assumes that music is not present at the start of the call. This allows the encoding rate selection apparatus of the present invention to properly estimate an initial background noise energy, $BGN_{init}$. Because music unlike background noise has a periodic characteristic, the present invention examines the value of NACF to distinguish music from background noise. The music detection method of the present invention computes an average NACF in accordance with the equation below:

$$NACF_{AVE} = \frac{1}{T}\sum_{i=1}^{T} NACF(i), \tag{16}$$

where $NACF^{(i)}$ is defined in equation 7, and where T is the number of consecutive frames in which the estimated value of the background noise has been increasing from an initial background noise estimate $BGN_{INIT}$.

If the background noise BGN has been increasing for the predetermined number of frames T and $NACF_{AVE}$ exceeds a predetermined threshold, then music is detected and the background noise BGN is reset to $BGN_{init}$. It should be noted that to be effective the value T must be set low enough that the encoding rate doesn't drop below full rate. Therefore the value of T should be set as a function of the acoustic signal and $BGN_{init}$.

The previous description of the preferred embodiments is provided to enable any person skilled in the art to make or use the present invention. The various modifications to these embodiments will be readily apparent to those skilled in the art, and the generic principles defined herein may be applied to other embodiments without the use of the inventive faculty. Thus, the present invention is not intended to be limited to the embodiments shown herein but is to be accorded the widest scope consistent with the principles and novel features disclosed herein.

We claim:

1. An apparatus for determining an encoding rate for an input signal in a variable rate vocoder comprising:

subband energy computation means for receiving said input signal and determining a plurality of subband energy values in accordance with a predetermined subband energy computation format;

a plurality of subband rate determination means wherein each of said plurality of subband rate determination means is for receiving a corresponding one of said plurality of subband energy values and determining a subband encoding rate in accordance with said corresponding one of said plurality of subband energy values to provide a plurality of subband encoding rates; and encoding rate selection means for receiving said plurality of said subband encoding rates and for selecting said encoding rate for said input signal in accordance with said plurality of subband encoding rates.

2. The apparatus of claim 1 wherein said subband energy computation means determines each of said plurality of subband energy values in accordance with the equation:

$$\text{subband energy} = R_S(0) \cdot R_{h_{pb}}(0) + 2 \cdot \sum_{i=1}^{L-1} R_S(i) \cdot R_{h_{pb}}(i),$$

where L is the number taps in the lowpass filter $h_L(n)$, where $R_S(i)$ is the autocorrelation function of the input signal, S(n), and where $R_{hbp}$ is the autocorrelation function of a bandpass filter $h_{bp}(n)$.

3. The apparatus of claim 1 further comprising threshold computation means disposed between said subband energy computation means and said rate determination means for receiving said subband energy values and for determining a set of encoding rate threshold values in accordance with said plurality of subband energy values.

4. The apparatus of claim 3 wherein said threshold computation means determines a signal to noise ratio value in accordance with said plurality of subband energy values.

5. The apparatus of claim 4 wherein said threshold computation means determines a scaling value in accordance with said signal to noise ratio value.

6. The apparatus of claim 5 wherein said threshold computation means determines at least one threshold value by multiplying a background noise estimate by said scaling value.

7. The apparatus of claim 6 wherein each of said subband rate determination means compares said corresponding subband energy value with said at least one threshold value to determine said subband encoding rate.

8. The apparatus of claim 1 wherein each of said subband rate determination means compares said corresponding subband energy value with at least one threshold value to determine said subband encoding rate.

9. The apparatus of claim 1 wherein said encoding rate selection means selects the highest rate of said plurality of subband encoding rates as said encoding rate.

10. An apparatus for determining an encoding rate for a variable rate vocoder comprising:

signal to noise ratio means for receiving an input signal and generating an estimate of the information signal energy in said input signal and for generating an estimate of the background noise energy in said input signal and for providing a signal to noise ratio in accordance with said estimate of the information signal energy, and said estimate of the background noise energy;

rate determination means for receiving said signal to noise ratio value and determining said encoding rate in accordance with said signal to noise ratio value.

11. An apparatus for determining an encoding rate for a variable rate vocoder comprising:

a signal to noise ratio calculator that receives an input signal and generates an estimate of the information signal energy in said input signal and generates an estimate of the background noise energy in said input signal and for providing a signal to noise ratio in accordance with said estimate of the information signal energy and said estimate of the background noise energy;

rate selector that receives said signal to noise ratio value and selects said encoding rate in accordance with said signal to noise ratio value.

12. A method for determining an encoding rate for an input signal in a variable rate vocoder comprising the steps of:

receiving said input signal;

determining a plurality of subband energy values in accordance with a predetermined subband energy computation format;

determining a corresponding subband encoding rate for each of said plurality of subband energy values to provide a plurality of subband encoding rates; and selecting said encoding rate for said input signal in accordance with said plurality of subband encoding rates.

13. The method of claim 12 wherein said step of determining a plurality of subband energy values is performed in accordance with the equation:

$$\text{subband energy} = R_S(0) \cdot R_{h_{pb}}(0) + 2 \cdot \sum_{i=1}^{L-1} R_S(i) \cdot R_{h_{pb}}(i),$$

where L is the number taps in the lowpass filter $h_L(n)$, where $R_S(i)$ is the autocorrelation function of the input signal, S(n), and where $R_{hbp}$ is the autocorrelation function of a bandpass filter $h_{bp}(n)$.

14. The method of claim 12 further comprising the step of determining a set of encoding rate threshold values in accordance with said plurality of subband energy values.

15. The method of claim 14 wherein said step of determining a set of encoding rate threshold values determines a signal to noise ratio value in accordance with said plurality of subband energy values.

16. The method of claim 15 wherein said step of determining a set of encoding rate threshold values determines a scaling value in accordance with said signal to noise ratio value.

17. The method of claim 16 wherein said step of determining a set of encoding rate threshold values determines said rate threshold value by multiplying a background noise estimate by said scaling value.

18. The method of claim 17 wherein said step of determining said corresponding subband encoding rate compares the corresponding subband energy value with said at least one threshold value to determine said corresponding subband encoding rate.

19. The method of claim 12 wherein said step of determining said corresponding subband encoding rate compares the corresponding subband energy value with at least one threshold value to determine said corresponding subband encoding rate.

20. The method of claim 12 wherein said step of selecting said encoding rate selects the highest rate of said plurality of subband encoding rates as said encoding rate.

21. A method for determining an encoding rate for a variable rate vocoder comprising the steps of:

receiving an input signal;

generating an estimate of the information signal energy in said input signal generating an estimate of the background noise energy in said input signal;

calculating a signal to noise ratio in accordance with said estimate of the information signal energy and said estimate of the background noise energy; and determining said encoding rate in accordance with said signal to noise ratio value.

22. A method for determining the presence of music in a variable rate vocoder, comprising the steps of:

receiving a frame of an input signal;

generating linear predictive coding (LPC) coefficients for said frame;

generating a normalized autocorrelation value in accordance with said frame and said LPC coefficients;

generating a background noise estimate for said frame;

generating an average normalized autocorrelation value for the consecutive frames in which said background noise estimate has been increasing from a predetermined initial background noise estimate; and determining the presence of music in accordance with said average normalized autocorrelation value and a predetermined threshold value.

* * * * *

UNITED STATES PATENT AND TRADEMARK OFFICE

CERTIFICATE OF CORRECTION

PATENT NO. : 5,742,734
DATED : April 21, 1998
INVENTOR(S) : DeJaco et al.

It is certified that error appears in the above-identified patent and that said Letters Patent is hereby corrected as shown below:

Column 8,
Line 24, before "rate selector" insert -- a --.

Signed and Sealed this

Second Day of August, 2005

JON W. DUDAS
*Director of the United States Patent and Trademark Office*